United States Patent [19]

Busse et al.

[11] 4,350,090

[45] Sep. 21, 1982

[54] MOTORIZED AND MICRO FEED LENGTH ADJUSTMENT FOR A PRESS FEED

[75] Inventors: Vernon E. Busse, Minster; Robert L. Schockman, St. Henry, both of Ohio

[73] Assignee: The Minster Machine Company, Minster, Ohio

[21] Appl. No.: 229,789

[22] Filed: Jan. 30, 1981

[51] Int. Cl.[3] ..... B30B 15/30

[52] U.S. Cl. ..... 100/216; 74/600; 83/244; 226/142

[58] Field of Search ..... 100/215, 216; 226/141, 226/142; 72/417, 421; 83/222, 244; 74/600

[56] References Cited

U.S. PATENT DOCUMENTS

| | | | |
|---|---|---|---|
| 2,319,485 | 5/1948 | Alabrune | 74/600 |
| 2,653,662 | 9/1953 | Biggert, Jr. | 74/600 X |
| 2,856,793 | 10/1958 | Budlong | 74/600 |
| 3,076,368 | 2/1963 | Groll | 100/216 X |
| 3,078,734 | 2/1963 | Wiig | 74/600 X |
| 3,090,250 | 5/1963 | Budlong | 74/600 |
| 3,216,277 | 11/1965 | Groll | 74/600 |
| 3,242,768 | 3/1966 | Munschauer | 74/600 |
| 3,244,023 | 4/1966 | Baringer et al. | 74/600 |
| 3,359,825 | 12/1967 | Wiig | 74/600 |
| 3,410,130 | 11/1968 | Franks et al. | 74/600 X |
| 3,456,465 | 7/1969 | Pax et al. | 100/216 X |
| 3,485,080 | 12/1969 | Lehmann | 74/600 |
| 3,528,318 | 9/1970 | Huston et al. | 74/600 |
| 3,529,542 | 9/1970 | Rasenberger | 100/215 |
| 3,546,967 | 12/1970 | Bruns | 74/600 |
| 3,635,102 | 1/1972 | Skeen | 74/600 |
| 3,709,050 | 1/1973 | Granger | 74/600 |
| 4,056,994 | 11/1977 | Ihle | 74/600 X |

FOREIGN PATENT DOCUMENTS

| | | | |
|---|---|---|---|
| 629236 | 6/1950 | United Kingdom | 100/216 |

*Primary Examiner*—Billy J. Wilhite

*Attorney, Agent, or Firm*—Albert L. Jeffers; John F. Hoffman

[57] ABSTRACT

The invention relates to a mechanism for adjusting the feed length of a rack and pinion roll feed mechanism of the type generally used for feeding strip stock into presses. The feed length adjusting mechanism comprises a hub member connected to the press shaft, a throw block connected to the hub, and a slide rotatably connected to the connecting rod of the rack and pinion drive for the feed. A slide is locked to the block by means of a piston and cylinder lock mechanism, and a lead screw is threadedly connected to the slide and rotated by a bidirectional pneumatic motor mounted to the block, whereby rotation of the lead screw causes the slide to translate within the slideway. This changes the length of the eccentric connection between the rotating block and connecting rod thereby proportionately changing its stroke and the amount of strip stock which is fed into the press during each cycle of the feed mechanism. A fluid union mounted to the adjustment mechanism supplies pressurized air to operate the lock mechanism and the pneumatic motor.

14 Claims, 7 Drawing Figures

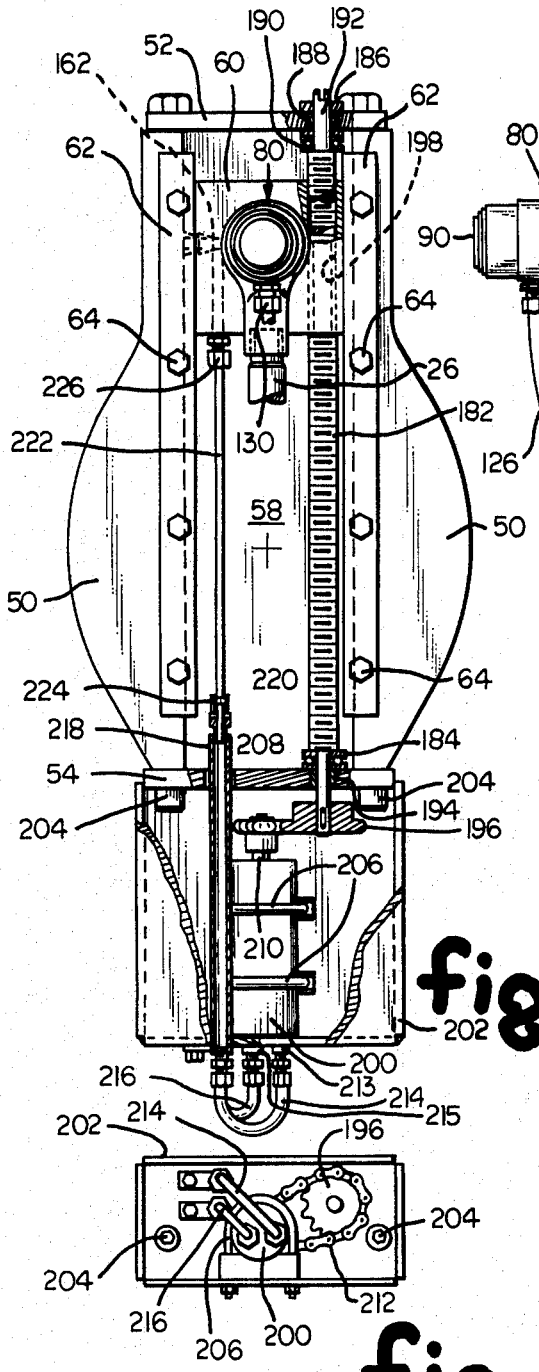
fig. 3
fig. 4
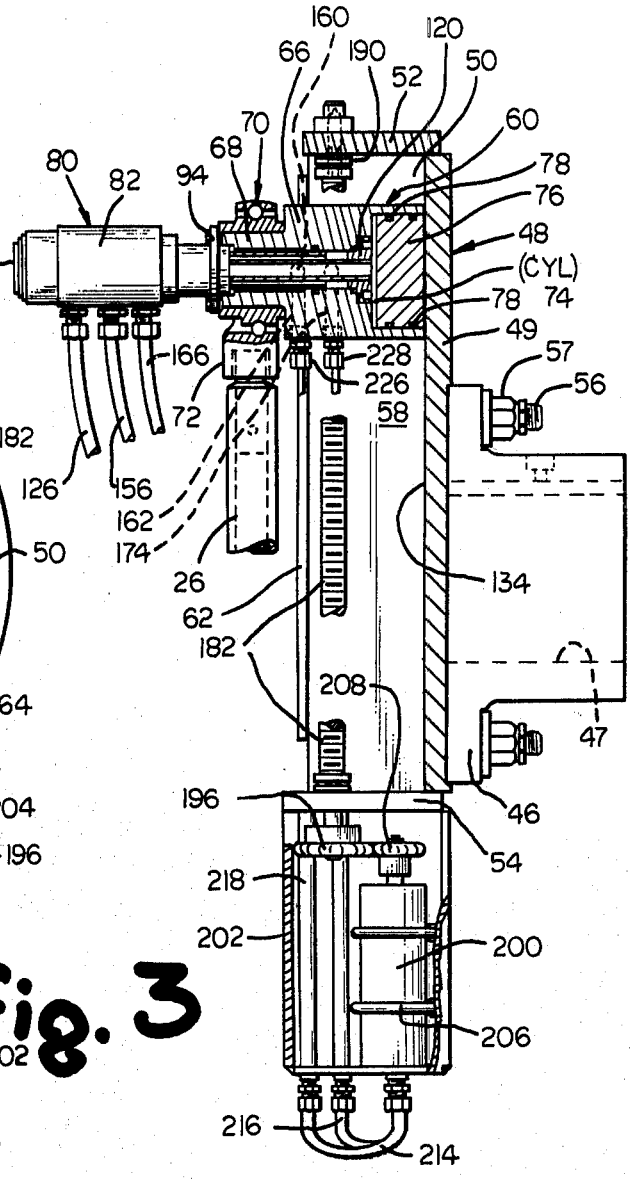
fig. 2

MOTORIZED AND MICRO FEED LENGTH ADJUSTMENT FOR A PRESS FEED

BACKGROUND OF THE INVENTION

The present invention relates to a rack and pinion feed for feeding strip stock into a machine, such as a press, and in particular to a motorized feed length adjustment mechanism therefor.

In order to feed sheet metal from supply rolls into a mechanical press, it is common practice to pinch the material between a pair of opposing feed rolls and drive the feed rolls in intermittent fashion in synchronism with the press by means of a power take-off from an extension of the press crankshaft extending out the the crown of the press. One such type of feed mechanism is known as a rack and pinion feed wherein an eccentric arm connected to the crankshaft extension is connected to a rack and pinion drive mechanism by a connecting rod. Such rack and pinion feed mechanisms are well known and have been in widespread use for many years.

In early feeds of this type, when it became necessary to adjust the stroke of the connecting rod in orer to change the length of material fed into the press on each cycle of the feed, it was necessary to stop the press and manually adjust the extent of movement of the crank arm. Since the adjustment mechanism is typically located coaxial with the crankshaft of the press, it was often necessary for the person to mount a ladder or scaffold to reach the adjustment mechanism. This operation proved to be quite cumbersome and time consuming, because it was often necessary to make a number of fine adjustments to attain the desired length of feed, with the necessity of again starting the press between each adjustment so that the change in feed length could be measured.

In order to enable adjustment of the feed length while the press was running, a number of motorized adjustment mechanisms were developed. One such adjustment mechanism employed an electric motor which rotated the feed screw or other threaded adjustment element through a rather large and complicated gear box. In addition to the large size and complexity of the gear mechanism which was needed to reduce the speed of the motor down to the slow speed necessary to make fine adjustments in the eccentric length, the electrical connections between the stationary and rotating portions of the feed necessitated the use of slip rings and brushes. The buildup of static charge on the slip rings often created false signals which caused the adjusting mechanism to move out of the position in which it was set. Additionally, the inherent overdrive characteristic of an electric motor does not permit the motor to be started and stopped with the degree of precision needed to make very fine adjustments.

Another type of adjusting mechanism for a rack and pinion feed employs a pneumatic motor to rotate the lead screw and an air cylinder to lock the slide against the block once the desired eccentric length is reached. An example of this type of adjustment mechanism is disclosed in patent 3,485,080, but has the disadvantage that the mechanical connections between the air motor and locking cylinder are quite complicated, thereby increasing manufacturing and maintenance costs.

SUMMARY OF THE INVENTION

The adjustment mechanism according to the present invention overcomes the problems and disadvantages of the prior art devices by providing a greatly simplified arrangement for connecting the three sources of pressurized air to the locking piston and pneumatic motor inlets, respectively. This is accomplished by means of a three passage fluid union or air distributor, which is mounted to the slide generally coaxial with the axis of rotation of the slide with respect to the connecting rod hanger bearing. The locking piston is received within a cylinder that is also coaxial with the fluid union and is forced into frictional engagement with the slideway by means of the pressurized air connected to the cylinder through one of the radially nested passages within the slide connected to a corresponding passage in the fluid union.

Two air lines are connected to the respective inlets of the pneumatic motor to provide for bidirectional rotation, and these lines are connected through a sliding O-ring seal and rigid tube or flexible arrangement to fluid outlets on the slide. These outlets are connected to concentric passages in the slide that are connected to corresponding passages in the fluid union.

The above arrangement has eliminated the complicated gearing and locking mechanisms of prior art motorized adjustment mechanisms, both of the electric and pneumatic type. In this way, the manufacturing cost of the mechanism has been substantially reduced, and it is less likely that maintenance problems will occur during the life of the mechanism, as opposed to the substantially more complicated prior art devices.

The mechanism is capable of making extremely fine adjustments in eccentric length, even while the press is running. Total control of the mechanism is accomplished by three fluid lines that connect from the fluid union to the appropriate control valves.

Specifically, the present invention relates to a feed apparatus for a press including a connecting rod and at least one feed roll driven by the connecting rod. The feed length adjustment mechanism comprises a hub member adapted to be connected to a rotating shaft in a press and rotated about an axis, a block connected to the hub and having a slideway therein, a slide received in said slideway for sliding movement in a direction transverse to the axis of rotation of the hub member, and means for rotatably connecting the slide to the connecting rod. A lock mechanism for locking the slide to the block comprises a cylinder in the slide having a lock piston mechanism therein and a fluid inlet for pressurizing the fluid and locking the piston mechanism against the block. A lead screw is threadedly connected to the slide and is rotated in two directions by a bidirectional pneumatic motor mounted to the adjustment mechanism and drivingly connected thereto by any appropriate means, such as a timing belt and pulleys or a chain and sprockets. A three passage fluid union mounted to the adjustment mechanism supplies pressurized fluid to the cylinder unit to lock the slide to the block and supplies pressurized fluid to a pair of inlets on the pneumatic motor to rotate the motor in either direction. The fluid union comprises three fluid passages contained in a rotatable inner member and three fluid conduits connecting the passages to the cylinder and motor inlets, respectively.

BRIEF DESCRIPTION OF THE DRAWINGS

FIG. 2 is an enlarged sectional view taken along line 2—2 of FIG. 1 and viewed in the direction of the arrows;

FIG. 3 is an elevational view of the adjustment mechanism of FIG. 2 viewed from the left side thereof, and wherein portions of the mechanism have been broken away to illustrate the details of construction;

FIG. 4 is a bottom view of the adjustment mechanism of FIG. 3 wherein the lower plate of the motor mounting bracket and housing has been removed to show the details of construction;

DESCRIPTION OF A PREFERRED EMBODIMENT

Figure 1:
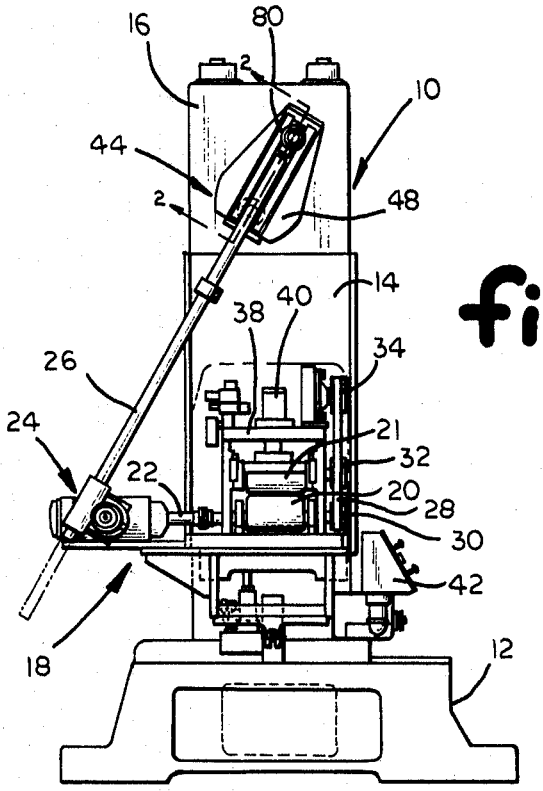
FIG. 1 is an elevational view of a mechanical press having a rack and pinion feed incorporating the motorized adjustment mechanism of the present invention.

Referring now in detail to the drawings, and in particular to FIG. 1, there is illustrated a mechanical press 10 of the type manufactured by the Minster Machine Company of Minster, Ohio. Press 10 comprises a bed and leg assembly 12, uprights 14 and a crown 16, the latter housing the press crankshaft having a shaft extension extending out of crown 16. The feed mechanism 18, which is of the rack and pinion type, comprises a pair of feed rolls 20 and 21 in opposing relationship and adapted to pinch strip stock fed from a stock supply roll (not shown) into the press 10 in intermittent fashion and in synchronism with it. Lower feed roll 20 is driven in intermittent fashion through a drive shaft 22 connected to rack and pinion drive assembly 24. Rack and pinion drive assembly 24 is of conventional design and includes an overrunning clutch which is rotated intermittently by the reciprocating motion of connecting rod 26. Upper feed roll 21 is driven in synchronism with lower feed roll 20 by means of a double sided timing belt 28 which is connected to the pulleys 30 and 32 on lower and upper feed rolls 20 and 21, respectively, and around idler pulley 34. One side of timing belt 28 engages pulleys 30 and 34 and the opposite side thereof engages pulley 32. This arrangement permits the spacing between feed rolls 20 and 21 to be changed for different stock thicknesses under zero backlash conditions.

Upper feed roll 21 is connected to yoke 38 that is raised and lowered in synchronism with the press by feed roll lift cylinder 40. Control panel 42 carries the controls necessary to operate the feed, and may either be attached to the press itself or to a freestanding cabinet.

The rotation of lower roll 20 may be monitored by means of a conventional digital readout mechanism (not shown) comprising an electronic digital counter having an input shaft connected to the shaft for the lower pulley 30 by a timing belt.

Referring now to FIGS. 2 through 4, the motorized micro feed length adjustment mechanism 44 of the present invention will be described in detail. It comprises a hub member 46 having a cylindrical opening 47 within which the crankshaft extension of the press is received and keyed thereto. A rectangular throw block 48 having a back 49, sides 50, a top plate 52 and a bottom plate 54 is connected to hub 46 by large bolts 56 and nuts 57. A slideway 58 is defined by the inner surfaces of the throw block back 49 and sides 50 and has received therein for sliding movement a slide 60. Slide 60 is retained within slideway 58 by a pair of retainer bars 62 that are connected to the side portions 50 of block 48 by screws 64.

Slide 60 comprises a main portion 66 and a smaller extension portion 68 having a bearing 70 mounted thereon. Hanger bearing 70 includes a threaded socket 72 within which the upper end of connecting rod 26 is threadedly received, whereby the slide 60 is able to rotate relative to connecting rod 26 as block 48 is rotated by the press crankshaft extension.

The main portion 66 of slide 60 has an open ended cylinder 74 therin (FIGS. 2 and 5) within which a lock piston 76 is slidably received and is sealed thereagainst by seals 78. A three-passage hydraulic untion 80 (FIG. 6) is connected to the slide extension 68, and is generally coaxial with the axis of the rotational movement of slide 60 within hanger bearing 70. Fluid union 80 comprises a generally annular outer member 82 having three annular passages 84, 86 and 88 therein, and an inner member 90 which is rotatably received within outer member 82 and sealed thereagainst by O-rings 92. Inner member 90 includes a flange portion 94 which is connected to the slide extension 68 by screews 96. Inner member 90 is rotatably supported within outer member 82 by bushings 98 and 100, wherein bushing 98 is retained in place by retainer 102, and bushing 100 is retained in place by retainer 104. Inner member 90 is held against movement within outer member 82 by bushing 98, retainer 106 and snap ring 108.

Figure 6:
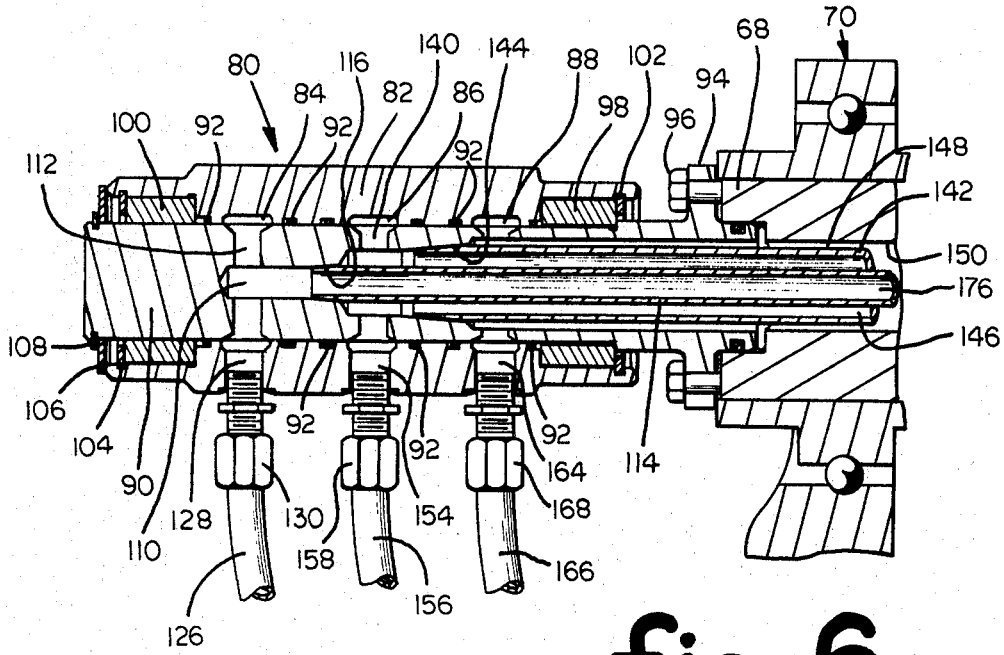
FIG. 6 is an enlarged sectional detail of the fluid union.
Figure 5:
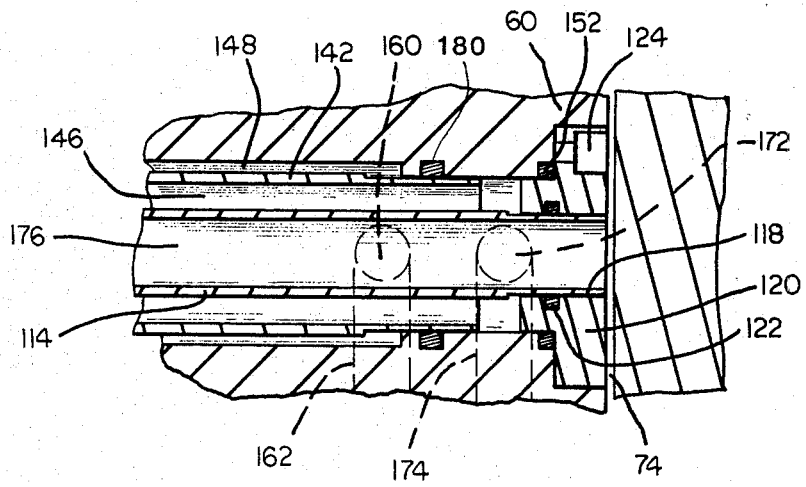
FIG. 5 is an enlarged, sectional detail of a portion of the slide.

Inner member 90 includes an axial passage 110 connected to annular passage 84 an outer member 82 by a plurality of radial passages 112, and an inner tubular member 114 is seated within a tapered recess 116 in passage 110 as illustrated in FIG. 6. With reference to FIG. 5, the other end of tubular member 114 is received within an opening 118 of collar 120 and sealed thereagainst by O-ring 122. Collar 120 is connected to slide 60 by screws 124.

A air supply line 126 is connected to a threaded opening 128 in outer member 82 by hose coupling 130, and opening 128 is in fluid communication with annular passage 84. Inner tubular member 114 permits pneumatic pressure from line 126 to be connected through collar 120 to the cylinder 74 of slide 60 within which piston 76 is received. When air hose 126 is pressurized, the increased pressure within cylinder 74 will force piston 76 into frictional engagement with the inner surface 134 of slideway 58 thereby locking slide 60 against translational movement within slideway 58. When air hose 126 is vented to the atmosphere, the pressure within cylinder 74 will drop to atmospheric thereby releasing piston 76 and slide 60 is unlocked to allow it to be moved within slideway 58.

As shown in FIG. 6, passageway 110 is enlarged at 140, and a second tubular member 142 is seated within tapered recess 144 to form an annular passageway 146 between it and inner tubular member 114 and a second annular passageway 148 between it and the surface of slide 60. As shown in FIG. 5, the other end of tubular member 142 is sealed against slide 60 by O-ring 152. Annular passageway 146 is in communication with port 154 through annular passage 86, and an air hose 156 is connected to port 154 by fitting 158. The other end of annular passge 146 is in communication with opening 160 (FIG. 5), which connects with air outlet passage 162.

The end of annuluar passage 148 shown in FIG. 6 is in communication with port 164 through annular passage 88, and a third air hose 166 is connected to port 164 by fitting 168. Annular passageway 146 is in communication with opening 172, which connects with passage 174. As can be seen, the air from hoses 126, 156, and 166 is connected to cylinder 74 and passages 162 and 174 in block 60 through the three concentric, nested passageways 148, 146 and 176, the last being the interior of inner tubular member 114. These passages are sealed on their distal ends by the seating of tubular members 142 and 114 is tapered recesses 144 and 116, and are sealed on their proximal ends by O-rings 152 and 180. Since block 60 rotates in unison with the crankshaft extension, inner member 90 of fluid union 80 will rotate relative to outer member 82, which is loosely held against movement by the air supply lines 126, 156 and 166.

Slide 60 is translated within slideway 58 by means of a threaded lead screw 182, which is supported on the lower plate 54 of block 48 by bearings 184, and is supported against lateral movement within upper plate 52 by collar 186 and bushing 188, and is supported against plate 52 for rotation by bearings 190. The upper end 192 of screw 182 extends beyond collar 186 and is provided with a slot or other means to enable it to be turned manually for fine adjustments. The lower end of screw 182 extends through a bushing 194 and is keyed to a sprocket 196. Lead screw 182 is threaded into a threaded opening 198 within slide 60, so that as lead screw 182 is turned about its axis, slide 60 will be translated in the respective direction within slideway 58. The threaded opening 198 in block 60 is positioned to the left of piston 76 as viewed in FIG. 2 and to the right of the fluid passages in slide 60 as viewed in FIG. 4.

Lead screw 182 is rotated about its axis by a combination pneumatic motor and speed reducer manufactured by the Gardner Denver Co. The pneumatic motor 200 is housed within motor housing 202, which is welded to the lower plate 54 of throw block 48 by screws 204, and is mounted to a sidewall thereof by U-clamps 206. A sprocket 208 is connected to the output shaft 210 of motor 200, and is connected to sprocket 196 by chain 212. Alternatively, conventional gears and a timing belt arrangement could be used in place of the sprockets 196 and 208 and chain 212.

Pneumatic motor 200 has two inlets 213 and 215 which are connected to loops of copper tubing 214 and 216, respectively. When pressurized air is connected to one of the inlets 213 and 215, motor 200 will rotate in one direction, and when the pneumatic pressure is connected to the other inlet, it will rotate in the opposite direction. The loops of copper tubing 214 and 216 are connected to respective rigid pipes 218, which extend through housing 202 and terminate in an adapter 220. A second pair of rigid tubes 222 are received, respectively, within adapters 220 and are sealed thereagainst by means of a sliding O-ring seal 224. The opposite ends of tubes 222 are connected by fittings 226 and 228 to passages 162 and 174, respectively. As slide 60 translates within slideway 58, tubes 222 will slide in a telescopic fashion within O-rings 224 and pipse 218. Alternatively, passages 162 and 174 could be connected to motor 200 via coiled, flexible hoses (not shown).

Figure 7:
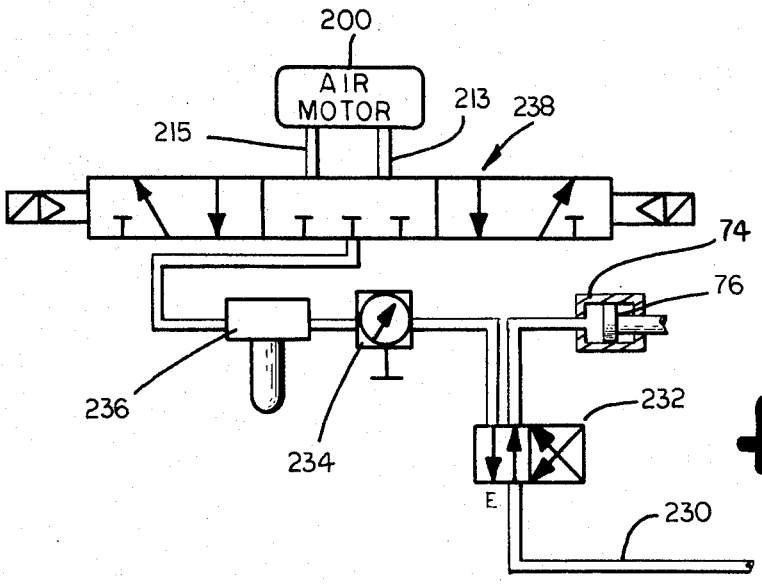
FIG. 7 is a schematic of the pneumatic system.

The schematic for the adjustment mechanism is illustrated in FIG. 7, and will be seen to comprise an air supply line 230 connected to an air compressor (not shown) and a four-way solenoid valve 232 having its outputs connected alternatively to supply line 230. In the position shown in FIG. 7, solenoid valve 232 connects supply line 230 to cylinder 74 so as to press the piston 76 against surface 134 of slideway 58, thereby locking slide 60 in place. In the alternate position, cylinder 74 is vented to atmosphere through valve 232 and the pressurized air is connected through regulator 234, lubricator 236 to a three position, spring centered solenoid valve 238. When valve 238 is moved to one position, the pressurized air is admitted to one of the inlets 213 or 215 of motor 200 and it rotates in one direction thereby turning the feed screw in the same direction and causing slide 60 to move either toward or away from the axis of rotation of the press crankshaft extension. The other port 213 and 215 is vented to atmosphere through valve 238. When valve 238 is moved to the opposite position, the pressurized air is connected to the other port 213 or 215 causing the motor 200 to rotate in the opposite direction producing opposite movement of lead screw 182 and slide 60. It will be noted that when valve 232 is moved to the position whereby pneumatic pressure is transmitted to valve 238, cylinder 74 will always be vented thereby permitting slide 60 to move. When valve 232 is moved to the other position such that pneumatic pressure is not transmitted to valve 238, cylinder 74 will automatically be pressurized and slide 60 locked in place.

The further that slide 60 is moved away from the axis of rotation of hub member 46, the longer will be the stroke of connecting rod 26, which increases the length of material fed into press 10 on each cycle thereof. Valve 238 is spring centered and adapted for intermittent operation so that a very slight degree of rotation of lead screw 182 can be effected by depressing the actuating button on the control panel 42 for a short period of time. In this way, slide 60 can be "inched" into position even while the press is running thereby enabling very precise adjustment of the feed length. By monitoring the digital encoding of the rotation of the driven roll 20, the actual feed length can be read out directly and very precise selection and control to feed length is possible.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In a feed apparatus for a press including a connecting rod and at least one feed roll driven by the connecting rod, a feed length adjustment mechanism for reciprocating said connecting rod comprising:

a hub member adapted to be connected to a rotating shaft in a press and rotated about an axis, a block connected to said hub member and having a slideway therein, a slide received in said slideway for sliding movement in a direction transverse to the axis of rotation of the hub member, means for rotatably connecting said slide to said connecting rod, lock means for locking said slide to said block comprising a cylinder in said slide having a lock piston mechanism therein and a fluid inlet means for pressurizing the cylinder and locking said piston mechanism against said block, a lead screw threadedly connected to said slide, a bidirectional fluid motor means mounted to the adjustment mechanism and being drivingly connected to said lead screw to rotate the same thereby translating said slide in said block, and a fluid union means mounted to said adjustment mechanism for supplying pressurized fluid to said cylinder inlet means to lock said slide to said block and for supplying pressurized fluid to a pair of inlets on said motor means to rotate the motor means in either direction, said fluid union means comprising three fluid passages contained in a rotatable inner member and three fluid conduits connecting said passages to said cylinder and motor means inlets, respectively.

2. The feed apparatus of claim 1 wherein said lock piston mechanism comprises a piston having one side immediately adjacent a surface in said slideway and said means for pressurizing the cylinder develops fluid pressure against the other side of said piston and forces said one side of the piston into frictional engagement with the surface of the said slideway.

3. The feed apparatus of claim 2 wherein: said means for rotatably connecting said slide and said connecting rod comprises a bearing, the conduit which is connected to said cylinder is coaxial with the rotation of said slide with respect to said connecting rod, and the last mentioned conduit passes through said bearing.

4. The feed apparatus of claim 1 wherein: said fluid union means is mounted to said slide, said fluid motor means is mounted to said block, and the fluid conduits connecting said fluid passages in said fluid union means to said motor means comprise telescoping tubes which permit translational movement of said fluid union means relative to said block.

5. The feed apparatus of claim 4 wherein the conduits connecting fluid passages in said fluid union means comprise passages formed in said slide and means connecting the passages in said slide to said telescoping tubes.

6. The feed apparatus of claim 1 wherein said feed appartaus comprises a rack and pinion mechanism connected to said connecting rod, and said rack and pinion mechanism is drivingly connected to at least one feed roll adapted for gripping and advancing strip stock when rotated.

7. The feed apparatus of claim 6 wherein said hub member is connected to the main crankshaft in a mechanical press.

8. The feed apparatus of claim 6 including a second feed roll and means for connecting said second feed roll to the first mentioned feed roll so that it rotates in unison therewith.

9. The feed apparatus of claim 1 wherein said fluid union means comprises: an outer member disposed around said rotatable inner member and said inner member is rotatably received in said outer member, said passages are radially nested in said inner member and are coaxial with the axis of rotation of said inner member with respect to said outer member, and three fluid inlets connected to said outer member.

10. The feed apparatus of claim 9 wherein: said means for rotatably connecting said slide and said connecting rod comprises a bearing, and said passages in said inner member are coaxial with the axis of rotation of said slide with respect to said bearing.

11. The feed apparatus of claim 10 wherein the conduit which is connected to said cylinder is coaxial with said passages in said inner member and passes through said bearing.

12. The feed apparatus of claim 10 wherein: said fluid union means is mounted to said slide, said fluid motor means is mounted to said block, and the fluid conduits connecting said fluid passages in said fluid union means to said motor means comprise telescoping tubes which permit the translational movement of said fluid union means relative to said block.

13. The feed apparatus of claim 1 including valve means having an inlet adapted to be connected to a source of pressurized air and outlets connected to said fluid union means, said valve means automatically connects pressurized air to the fluid passage connected to said cylinder when no pressurized air is connected to the passages and conduits connected to said motor means inlets.

14. The feed apparatus of claim 13 wherein said valve means automatically vents said cylinder when pressurized air is connected to one of said motor means inlets.

* * * * *

UNITED STATES PATENT AND TRADEMARK OFFICE

CERTIFICATE OF CORRECTION

PATENT NO. : 4,350,090

DATED : September 21, 1982

INVENTOR(S) : Vernon E. Busse & Robert L. Schockman

It is certified that error appears in the above—identified patent and that said Letters Patent is hereby corrected as shown below:

Col. 1, line 23, "orer" should be -- order --.

Col. 4, line 4, "hanger" omitted between "a" and "bearing".

Col. 4, line 11, "therin" should be -- therein --.

Col. 4, line 13, "untion" should be -- union --.

Col. 4, line 22, "screews" should be -- screws --.

Col. 4, line 57, "150" omitted between "surface" and "of"

Col. 5, line 9, "is" should be -- in --.

Col. 5, line 58, "pipse" should be -- pipes --.

Col. 6, line 11, "and" should be -- or --.

Claim 2, Col. 7, line 19 "the" should be deleted.

Signed and Sealed this

*Eleventh* Day of *January 1983*

[SEAL]

*Attest:*

GERALD J. MOSSINGHOFF

*Attesting Officer*

*Commissioner of Patents and Trademarks*